US010350505B2

(12) United States Patent
Chan et al.

(10) Patent No.: US 10,350,505 B2
(45) Date of Patent: Jul. 16, 2019

(54) TOY WITH AN ILLUMINABLE MOVABLE PORTION

(71) Applicant: Mattel, Inc., El Segundo, CA (US)

(72) Inventors: Patricia Chan, Redondo Beach, CA (US); Steven D. Ryniker, Torrance, CA (US); James P. Zielinski, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 1403 days.

(21) Appl. No.: 14/147,059

(22) Filed: Jan. 3, 2014

(65) Prior Publication Data

US 2014/0273722 A1 Sep. 18, 2014

Related U.S. Application Data

(60) Provisional application No. 61/791,383, filed on Mar. 15, 2013.

(51) Int. Cl.
*A63H 3/00* (2006.01)
*A63H 33/22* (2006.01)

(52) U.S. Cl.
CPC ..... *A63H 3/006* (2013.01); *A63H 33/22* (2013.01)

(58) Field of Classification Search
USPC ..... 446/219, 268–395; 434/198
See application file for complete search history.

(56) References Cited

U.S. PATENT DOCUMENTS 740,817 A * 10/1903 Davis ..... A63H 19/20 446/219
876,739 A 1/1908 Siever et al.
(Continued)

FOREIGN PATENT DOCUMENTS

DE 1013893 A 8/1957
GB 1385064 A 2/1975
(Continued)

OTHER PUBLICATIONS

German Patent and Trademark Office, Application No. 102013113549.8, Office Action dated Nov. 28, 2014 (including English Translation of pp. 4-5).

(Continued)

*Primary Examiner* — Eugene L Kim
*Assistant Examiner* — Matthew B Stanczak
(74) *Attorney, Agent, or Firm* — Edell, Shapiro & Finnan, LLC

(57) ABSTRACT

A toy doll with an illuminable movable portion is a toy doll with an illumination source, a first portion, and second portion. The second portion is movable with respect to the first portion and includes at least two panels which define housings configured to be illuminated. Each of the housings may include illumination areas, which, upon being aligned with the illumination source may become illuminated. Each of the panels may be selectively aligned with the illumination source. By illuminating different panels of the second portion, the toy doll can be configured in various illumination configurations. A user can influence which panels are illuminated by orienting the toy doll in certain orientations or moving the second portion to different locations with respect to the first portion, among other factors.

22 Claims, 10 Drawing Sheets

(56) References Cited

U.S. PATENT DOCUMENTS 2,853,799 A * 9/1958 Magnussen ..... G09B 7/066 434/340
3,440,349 A 4/1969 Gibbs
3,594,949 A 7/1971 Tam
3,654,710 A 4/1972 Barnard
3,740,039 A 6/1973 Prola
3,791,068 A * 2/1974 Pietrowiak ..... A63H 3/12 446/321
3,827,161 A * 8/1974 Nelson ..... G09B 19/02 434/198
4,056,896 A * 11/1977 Karasawa ..... A63H 13/02 446/191
4,206,495 A * 6/1980 McCaslin ..... G02B 6/4298 362/234
4,209,941 A 7/1980 Bourque
4,445,867 A * 5/1984 Berg ..... A63F 3/00643 40/495
4,568,086 A * 2/1986 Krogh ..... A63F 3/0415 273/141 R
4,585,231 A * 4/1986 Batmanghlich ..... A63F 9/0613 273/155
4,634,385 A * 1/1987 Stemper ..... G09B 1/22 434/198
4,998,366 A * 3/1991 Richaud ..... G09F 19/02 40/414
5,041,044 A 8/1991 Weinreich
5,057,051 A * 10/1991 Babicz ..... A63H 33/00 446/227
5,084,803 A 1/1992 Lan
5,090,144 A * 2/1992 Liu ..... A63H 3/38 40/410
5,228,879 A * 7/1993 Fromm ..... A63H 33/22 362/140
5,277,644 A * 1/1994 Osborne ..... A63H 3/006 446/219
5,288,259 A * 2/1994 Konta ..... A63H 3/44 362/551
5,291,577 A * 3/1994 Zoscak ..... A63H 3/006 362/565
5,324,224 A * 6/1994 Anderson ..... A63H 33/26 362/184
5,370,399 A * 12/1994 Liverance ..... G07F 17/3244 434/323
5,439,407 A * 8/1995 Friedel ..... A63H 3/006 362/806
5,545,072 A 8/1996 Arad et al.
RE35,556 E 7/1997 Weinreich
D381,596 S * 7/1997 Cord ..... D11/53
5,730,638 A * 3/1998 Ward ..... A63H 3/28 362/108
5,733,167 A 3/1998 Kroigaard
5,876,262 A * 3/1999 Kelly ..... A63H 33/22 108/23
5,947,789 A 9/1999 Chan
5,971,761 A * 10/1999 Tillman, Sr. ..... G09B 5/06 434/159
6,036,576 A 3/2000 Colon, Jr.
6,080,034 A 6/2000 Bennett Harris
6,135,599 A * 10/2000 Fang ..... A63H 33/30 353/28
6,190,229 B1 * 2/2001 Nadel ..... A63H 3/006 446/219
6,238,261 B1 * 5/2001 Lang ..... A63H 33/22 434/407
6,322,421 B1 11/2001 Hou
6,371,827 B1 4/2002 Chou
6,450,855 B1 9/2002 Tang
6,948,999 B2 9/2005 Chan
6,955,581 B1 10/2005 Liu
7,077,553 B2 * 7/2006 Vanderschuit ..... A63H 27/10 362/253
D572,624 S * 7/2008 Garrison ..... D11/121
7,654,023 B2 * 2/2010 Peters ..... G09F 9/305 40/547
8,936,501 B2 * 1/2015 Bell ..... A63H 3/006 446/219
2006/0123678 A1 * 6/2006 Arvin ..... G09F 13/02 40/547
2007/0087658 A1 * 4/2007 Wendorf ..... A63H 33/22 446/484
2007/0128979 A1 * 6/2007 Shackelford ..... A63H 3/001 446/484
2008/0166945 A1 * 7/2008 Cheng ..... A63H 11/20 446/268
2009/0264043 A1 * 10/2009 Wittenberg ..... A63H 3/006 446/297
2010/0029169 A1 * 2/2010 Lin ..... A63H 27/10 446/219

FOREIGN PATENT DOCUMENTS

GB 2026331 A 2/1980
GB 2199256 A 7/1988
GB 2277881 A 11/1994
GB 2291816 A 7/1996
WO 93/23128 A1 11/1993

OTHER PUBLICATIONS

UK Intellectual Property Office, Application No. GB1321330.1, Office Action dated Apr. 22, 2014.

* cited by examiner

TOY WITH AN ILLUMINABLE MOVABLE PORTION

CROSS-REFERENCE TO RELATED APPLICATION

This application claims priority to and is based on U.S. Patent Application No. 61/791,383, filed Mar. 15, 2013, entitled "Toy with an Illuminable Movable Portion," the entire disclosure of which is incorporated by reference herein in its entirety.

FIELD OF THE INVENTION

The present invention relates to toys with illuminable portions. More specifically, the present invention relates to a toy doll, insofar as a toy doll may include any toy figurine, and in particular, to a toy doll that has one or more movable portions that are illuminated by a light source. Furthermore, the present invention relates to a toy doll that includes at least one movable portion, each of the at least one movable portions being configured to be selectively illuminated or, in other words, being illuminable.

BACKGROUND OF THE INVENTION

Toys with illumination features have been and continue to be a stable source of amusement for children. Specifically, toy dolls have been and also continue to be a stable source of amusement for children. With regards to dolls, any enhancements, accessories, and features that spark a child's imagination and provide continued engagement of the toy doll with the child add to a doll's play value and build a bond between the child and the toy doll. In light of the above, there is a need for toys with creative illumination play features, and in particular, there is a need for a toy doll with a visually stimulating play feature to capture a child's attention and increase the play value of the toy doll.

SUMMARY OF THE INVENTION

According to at least one embodiment of the present invention, a toy with an illuminable portion is a toy doll that includes a first portion and a second portion that is coupled to the first portion and movable relative to the first portion between a first position and a second position. The first portion includes an illumination source and the second portion includes at least two panels. Each panel defines a housing that is illuminable when aligned with the illumination source and at least a first panel of the at least two panels is alignable with the first portion in the first position and at least a second panel of the at least two panels is alignable with the first portion in the second position.

In some embodiments, the first portion is a torso of a toy figure. In other embodiments, the second portion is wings that are coupled to the first portion and extending therefrom. In still other embodiments, the second portions is a tail that is coupled to the first portion and extending therefrom.

According to other embodiments, the at least two panels of the toy doll are disposed in a stacked configuration. Further, in some embodiments, the toy doll also includes at least one light reflective layer adjacent to one of the at least two panels, the light reflective layer reflecting light back into the panel to which it is adjacent.

In yet other embodiments, the first panel, when aligned with the illumination source, emits a first pattern of light outputs and the second panel, when aligned with the illumination source, emits a second pattern of light outputs, the first pattern differing from the second pattern. In some of these embodiments, the first pattern illuminates a first part of the second portion and the second pattern illuminates a second part of the second portion, the first and second parts being offset from each other so that both parts may be seen when illuminated simultaneously. In other embodiments, the first pattern of light outputs is a first color and the second pattern of light outputs is a second color, the first and second color being different colors.

According to another embodiment of the present invention, a toy with an illuminable portion includes a first portion and a second portion that is movably coupled to the first portion. The first portions includes a plurality of illumination sources housed therein, and the second portion includes a first panel and a second panel. The first and second panel are each illuminable when aligned with one of the illumination sources and each are alignable with at least one of the plurality of illumination sources.

In some of these embodiments, the second portion is movably coupled to the first portion via a mounting, the mounting allowing the second portion to move about the first portion such that at least one of the first panel or second panel can be moved into alignment with the illumination source. In some embodiment with a mounting, the mounting includes a rotatable support member. The rotatable support member allows the second portion to pivot about the first portion such that at least one of the first panel or second panel can be moved into alignment with the illumination source.

In yet other embodiments, the second portion includes at least two parts, each of the two parts including the first panel and the second panel and the mounting includes a flexible support member that couples the at least two parts together. The flexible support member is configured to move the at least two parts in unison.

In still other embodiments, the mounting allows the second portion to slide with respect to the first portion, such that at least one of the first panel or the second panel can be moved into alignment with the illumination source.

According to at least one other embodiment, the first portion is a set of wings, the second portion a torso of a toy figure, and the mounting portion is configured to allow the wings to move in a flapping motion.

In another embodiment, the toy also includes a manipulation mechanism. The manipulation mechanism may move the second portion with respect to the first portion by manipulating at least one of the mounting or the second portion.

According to another embodiment of the present invention, a toy with an illuminable portion includes a first portion, a second portion, and a sensor. The first portion includes a plurality of illumination sources housed therein. The second portion is movably coupled to the first portion, and includes a first panel and a second panel. The first and second panels are each alignable with at least one of the plurality of illumination sources and each panel is illuminable when aligned with one of the plurality of illumination sources. The sensor is electronically coupled to the illumination source and configured to manipulate the plurality of illumination sources in response to movement of the second portion.

According to some embodiments, the second portion comprises at least two parts. In some of these embodiments, the illumination source comprises at least two illumination sources, and each illumination source is aligned with one of the at least two parts so that each part may be selectively illuminated. Still further, in some of these embodiments, each of the illumination sources may be selectively illuminated in response to inputs detected by the sensor.

BRIEF DESCRIPTION OF THE DRAWINGS

Like reference numerals have been used to identify like elements throughout this disclosure.

DETAILED DESCRIPTION OF THE INVENTION

Generally referring to the figures, at least one exemplary embodiment of a toy with an illuminable movable portion is shown. The movable portion, which may also be referred to as a second portion, is movable with respect to a first portion of the toy and the second portion, or sections thereof, may be selectively illuminated as the second portion of the toy is moved relative to the first portion of the toy. In some embodiments, the second portion may be movably mounted to the first portion by a mounting which allows the second portion to rotate or pivot about or around the first portion.

Figure 1:
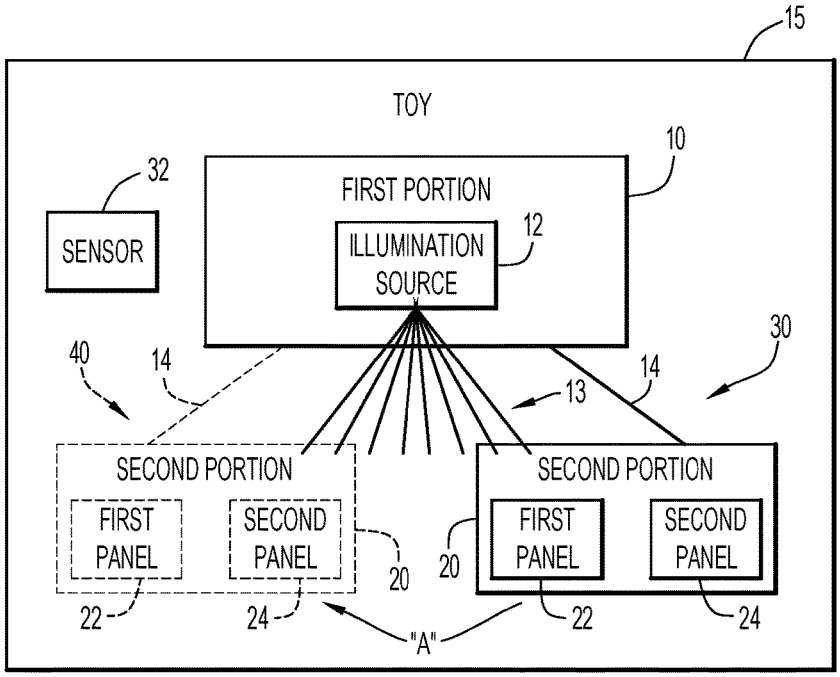
FIG. 1 shows a block diagram of an exemplary embodiment of a toy with an illuminable movable portion in accordance with the present invention.

For example, as shown in the block diagram of FIG. 1, a toy 15 includes a first portion 10 that is movably connected to a second portion 20 via a mounting 14 that allows the second portion 20 to move between a first configuration 30 and a second configuration 40 (shown in dashed lines). The first portion 10 includes an illumination source 12 that emits a light output 13 and the second portion includes panels 22 and 24 that are configured to be selectively illuminated when aligned with the light output 13. When one of the panels 22, 24 is aligned with the light output 13, the panel 22, 24 may illuminate a part, section, or pattern within the second portion 20. When a part, section, or pattern of a panel is illuminated, this may be referred to as an illumination configuration.

Still referring to FIG. 1, when the toy 15 is initially in configuration 30, a first panel 22 is aligned with the illumination source 12 and results in a first illumination configuration. Then, as the second portion 20 rotates or pivots about or around the first portion 10 in the direction of arrow "A" from configuration 30 to configuration 40, the first panel 22 moves out of alignment with the illumination source 12 and a second panel 24 moves into alignment with the illumination source 12. When the second panel 24 moves into alignment with the illuminationsource 12, a different part, section or pattern of second portion 20 is illuminated, resulting in a second illumination configuration. In this manner, a crude light animation may be produced, where the addition of further panels may refine the animation. Thus, while FIG. 1 only includes a second portion 20 with two panels 22, 24, other embodiments may include more than two illuminable panels configured to be selectively illuminate at least a part of the second portion 20. Furthermore, in additional embodiments, the second portion 20 may slidably move with respect to the first portion 10 to change illumination configurations. For example, the second portion 20 may slide along a track connected to the first portion 10. Moreover, the toy 15 may include a sensor 32, as a described in further detail below.

Figure 2:
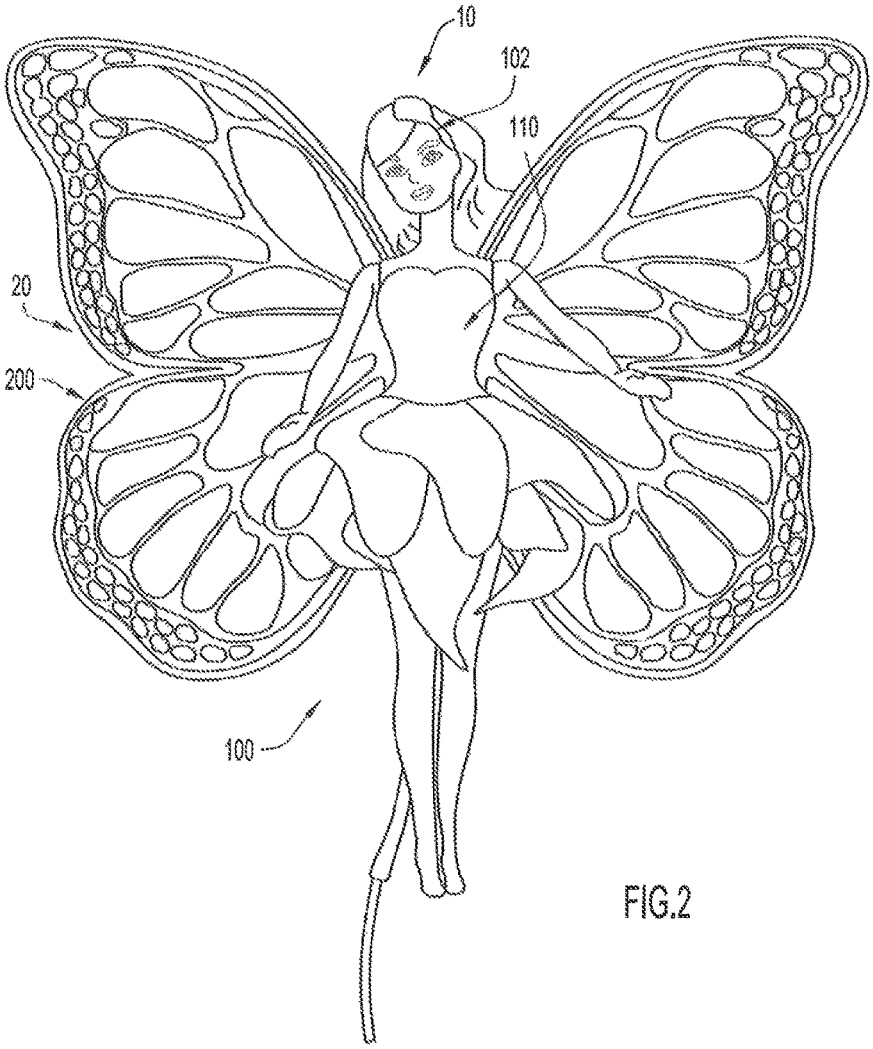
FIG. 2 shows a front perspective view of an exemplary embodiment of a toy doll with an illuminable movable portion in accordance with the present invention, where the illuminable movable portion is a set of wings.
Figure 3:
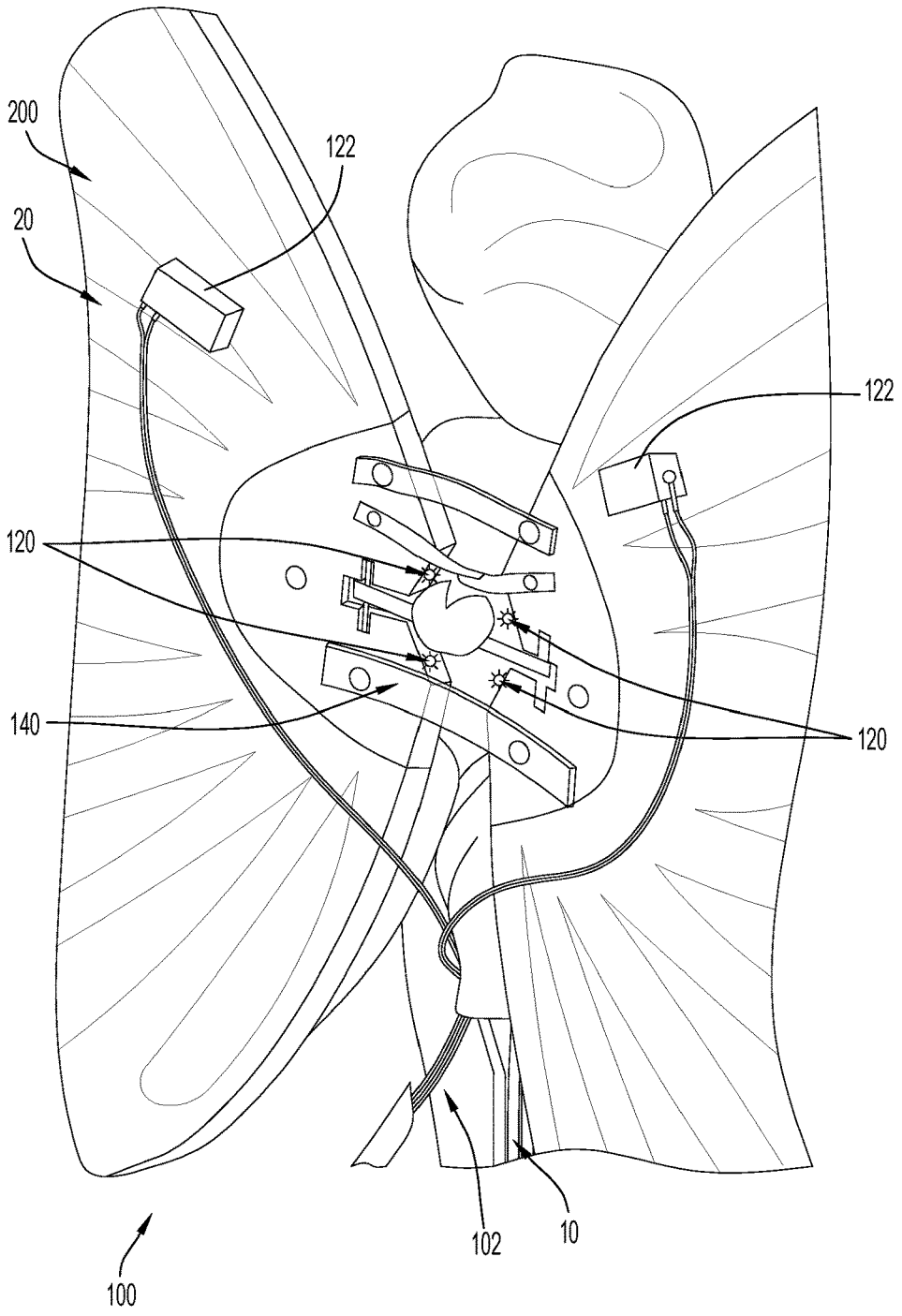
FIG. 3 shows a rear perspective view of the exemplary embodiment of FIG. 1 with an illumination source included within a mounting and the illumination source being activated.

Turning now to FIGS. 2-3, in one exemplary embodiment, the second portion 20 is a set of wings, and the first portion 10 is a body 102 of a human-shaped toy doll. More specifically, FIG. 2 shows a front perspective view of a toy doll 100 with a body 102 and wings 200 while FIG. 3 shows a rear perspective view of the same toy doll 100. However, in other embodiments, first portion 10 and second portion 20 may each be any part or portion of any desirable toy that is movably connected to each other. For example, second portion 20 could be the tail of a mermaid-type doll, and first portion 10 could be the torso of that same doll.

As shown in FIG. 3, wings 200 are permanently coupled to body 102 via a doll mounting 140 that includes various fasteners, welds and support members that allow the wings 200 to be pivotably coupled to body 102. In other embodiments, the second portion 20 of the toy doll 100 may be removably coupled to first portion 10 of the toy doll, and the second portion 20 may be rotatable, slidable, or otherwise movable with respect to first portion 10 in any desirable manner or direction such that the second portion 20 may be placed in one of a plurality of positions or alignments with respect to the first portion 10. The mounting 140 may also include, cover, support or otherwise be disposed near any number of illumination sources 12. In the configuration shown in FIG. 3, each quadrant of the set of wings 200 is illuminated by its respective illumination source 120 as the set of wings 200 rotates or pivots with respect to body 102.

Figure 4:
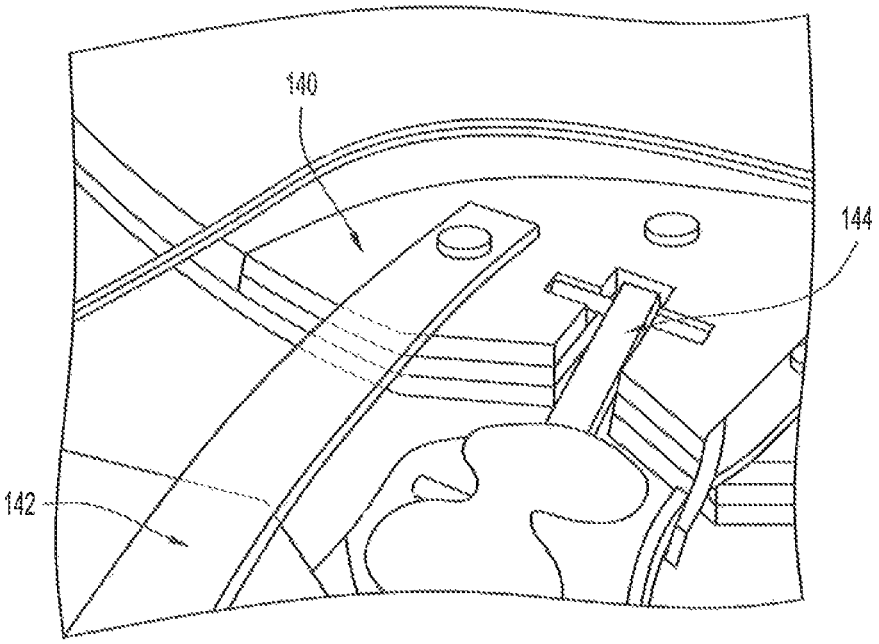
FIGS. 4-5 show perspective views of the mounting shown in FIG. 3, FIG. 4 showing the mounting in an unflexed position and FIG. 5 showing the mounting in a flexed position.
Figure 5:
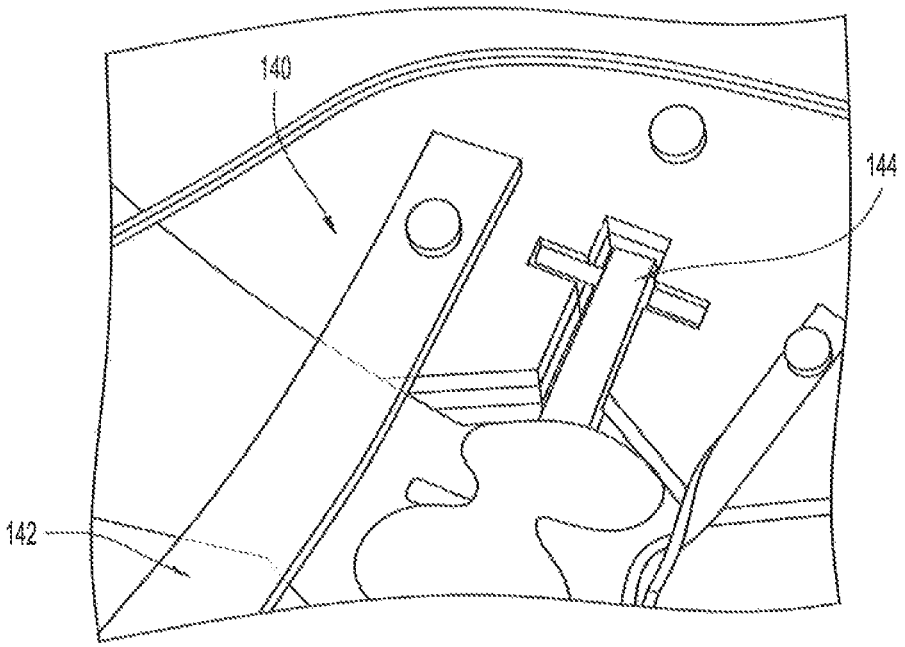

Now turning to FIGS. 4-5, with continued reference to FIGS. 2-3, doll mounting 140 allows wings 200 to rotate or pivot with respect to body 102. In this particular embodiment, wings 200 are mounted, via mounting 140, to body 102 on the rear of torso 110 (See FIG. 2), such that the toy doll may have the appearance of a fairy or winged-human. More specifically, in the particular embodiment shown in FIGS. 4-5, mounting 140 couples wings 200 to torso 110 in an orientation such that wings 200 extend symmetrically from the center of torso 110 and can rotate or pivot about the central vertical axis of body 102 in a flapping-type motion from a forward position to a rearward position. For clarity, the terms "forward position" and "rearward position" simply refer to the positions of the wings 200 at the front and rear apexes of the flapping motion.

Still referring to FIGS. 4-5, with continued reference to FIGS. 2-3, doll mounting 140 may include flexible support members 142 and rotatable supports 144 that, together, may facilitate or allow rotational movement. In the particular embodiment shown in FIGS. 4-5, the flexible support members 142 and the rotatable supports 144 each couple the two wings included in the set of wings 200 together and the rotatable supports 144 also couple wings 200 to body 102. However, in other embodiments, any combination of fasteners or supports may be used in order to allow the second portion 20 to move about the first portion 10 of a toy in accordance with the scope of this invention.

In the particular embodiment shown in FIGS. 4-5, rotatable supports 144 anchor a central portion of the wings 200 to a central location on torso 110 while the flexible support members 142 couple the two wings of wings 200 together while still allowing wings 200 to rotate or pivot around body 102. For example, flexible support members 142 may be able to flex from an unflexed or convex position (seen in FIG. 4) to a flexed or concave position (seen in FIG. 5) as the wings 200 rotate or pivot from a forward position to a rearward position. By comparison, the ends of the rotatable supports 144 proximate wings 200 may move forward or backwards while a central portion of supports 144 (if a single rotatable support 144 extends between both wings) or an end of supports 144 proximate to body 102 (if rotatable support 144 includes two supports extending oppositely outward from the body 102) may remain fixed. Thus, wings 200 remain coupled to body 102 even while moving between a forward and rearward position.

In some embodiments, a mounting 14 may include a detent, allowing the second portion 20 to be at least temporarily secured in a forward or rearward position. Similarly, in other embodiments, a mounting 14 may include a biasing member that may bias the second portion 20 in a certain position, such as a forward position. For example, in the doll mounting 140 shown in FIGS. 4-5, either rotatable supports 144 or flexible support members 142 may include or be coupled to a biasing member, such as a spring, which biases the wings 200 towards a forward position.

Furthermore, and with reference to FIGS. 1-5, it is to be understood that the second portion 20 of a toy 15 may be moved around the first portion 10 in any desirable manner. In the embodiment depicted in FIGS. 2-5, the wings 200 may be manipulated by hand, for example, by way of pulling the wings 200, a pull string, or any other desirable manipulation mechanism connected to the wings 200 in the desired direction. In other embodiments, wings 200 may be mechanically or electrically actuated as desired. For example, fluttering of the wings 200 may be motorized. However, regardless of how the second portion 20 moves with respect to the first portion 10, as the second portion 20 moves, different parts or sections of the second portion 20 may move into and out of alignment with one or more illumination sources 12 included in the first portion 10, as discussed in further detail below. For example, a first portion 10 may be aligned with a section of a second portion 20 when light from an illumination source 12 in the first section 10 impinges on the section of the second portion 20. In the present embodiment, the body 102 includes four illumination sources 120 mounted thereon (See FIG. 3), so that each wing of wings 200 rotates or pivots about two illumination sources 120. Additionally, the toy doll 100 may also include various sensors and/or switches (depicted as sensor 32 in FIG. 1), such as tilt sensors. 122 in FIG. 3. Any included sensors or switches may be incorporated into or onto mounting 140, body 102 or wings 200, as desired.

Figure 6:
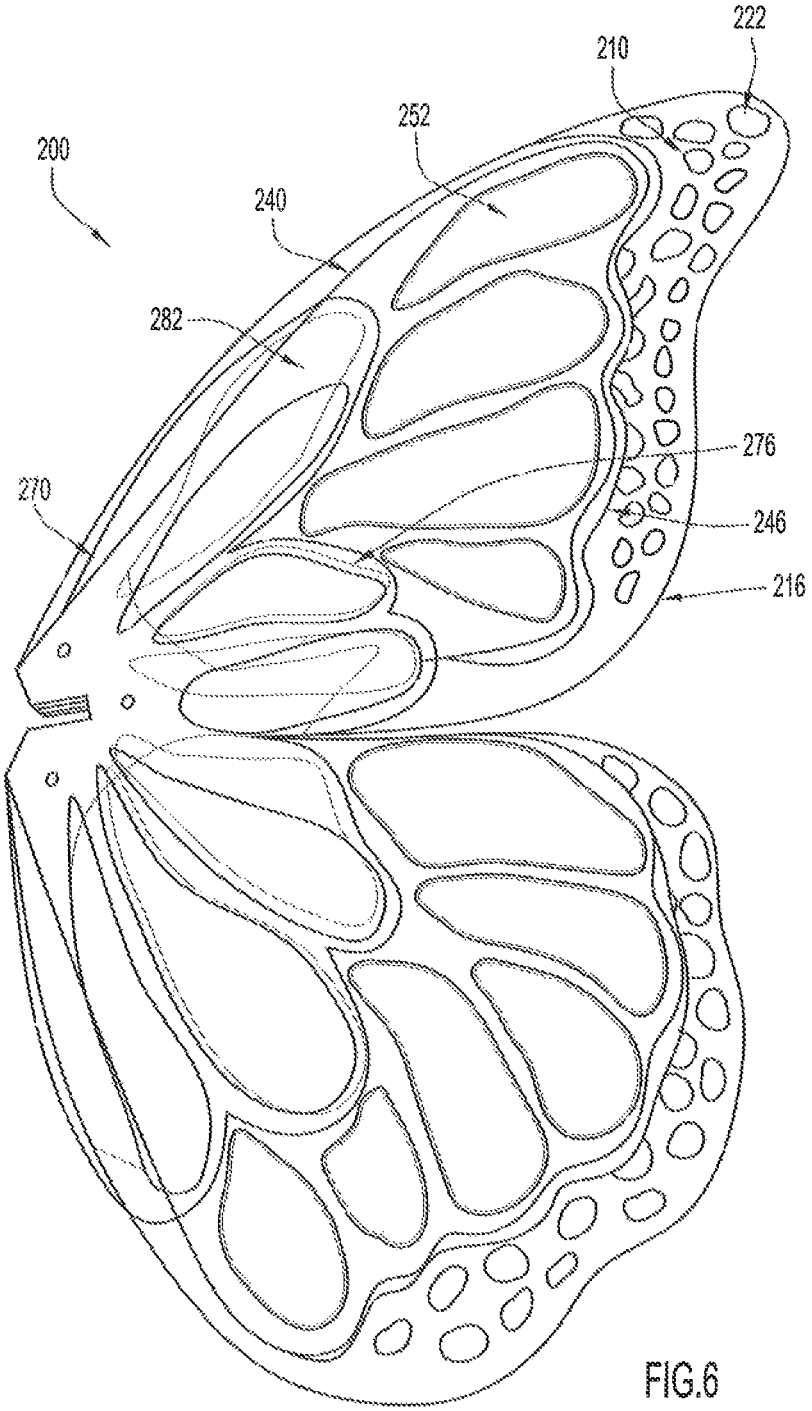
FIG. 6 shows a front perspective view of a portion of another exemplary embodiment of a toy doll with an illuminable movable portion in accordance with the present invention.

Turning now to FIG. 6, one half of a set of wings 200 is shown. Although only one half of a set of wings 200 is shown, it is to be understood that the wings 200 included in the present invention are substantially symmetrical, and thus, any description relating to half of wings 200 should be understood to apply to the entire set of wings 200. Accordingly, although the following wing 200 will be described to include a first section or panel 210, a second section or panel 240 and a third section or panel 270, it is to be understood that panels 210, 240, 270 are included in the entirety of a set of wings 200. However, it is also to be understood that the present invention does not require symmetrical wings 200 and that any desired wing configuration could be incorporated as a second portion 200. Similarly, although the second portion 200 is depicted as a four-quadrant, butterfly-style wing with three panels in FIG. 6 (only half of the wings 200 being shown in FIG. 6) it is to be understood that other embodiments of second portion 200 may be shaped as desired and may include two or more panels.

Figure 10:
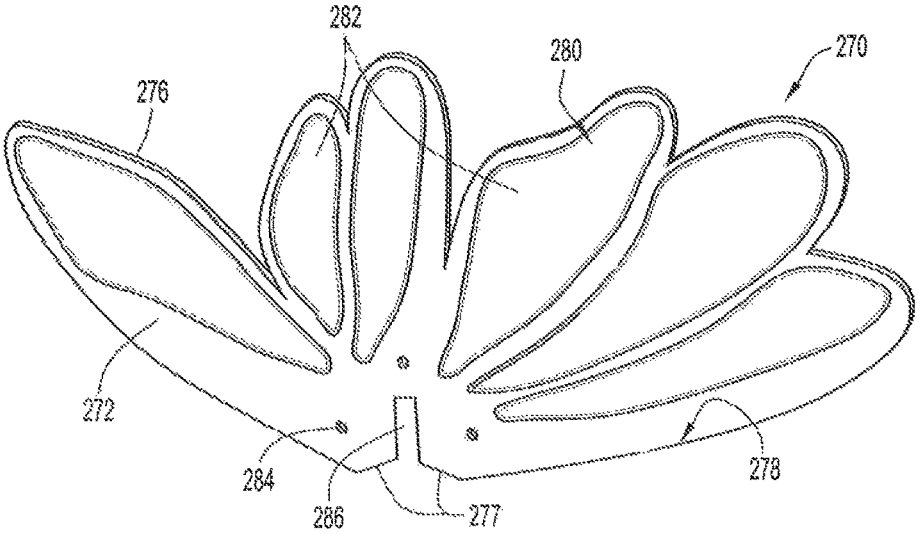
Figure 11A:
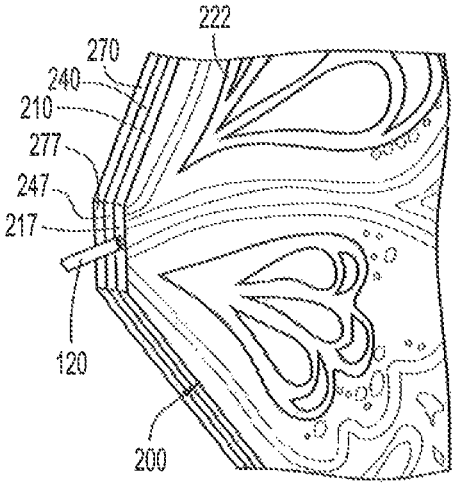
FIGS. 11A-C show perspective views of another exemplary embodiment of an illuminable movable portion, in accordance with the present invention, but detached from a toy doll.
Figure 11B:
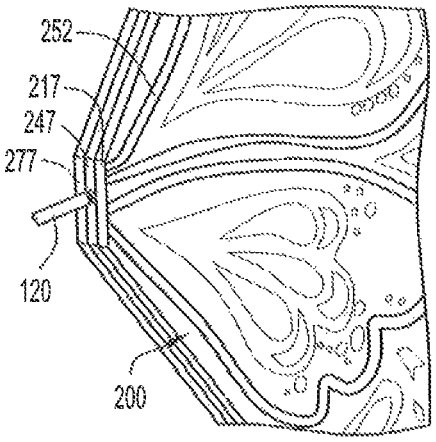
Figure 11C:
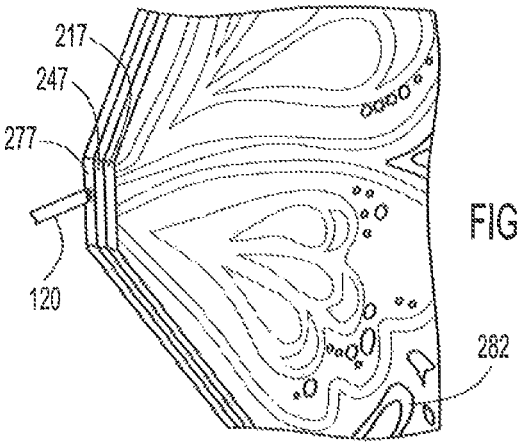

Still referring to FIG. 6, each panel 210, 240, 270 includes an exterior edge 216, 246, 276 and an entry edge 217, 247, 277 (see FIGS. 11A-C). Additionally, each panel 210, 240, 270 includes a housing 220, 250, 280 (See FIGS. 7-10) that comprises illumination areas 222, 252, and 282. The illumination areas 222, 252, and 282 may be sections of deformities on the panel. For example, the illumination areas 222, 252, and 282 may include etchings in, frostings on, or sanded areas of the panel surface. The deformities may aid in extracting light refracting from inside the panel, and hence illuminating the area with the deformities. As shown in FIG. 6, the panels 210, 240, 270 have complimentary patterns of illumination areas 222, 252, 282 that do not overlap from the viewpoint of a potential viewer. As will be explained in further detail below, each illumination area 222, 252, 282, may be selectively illuminated depending on, among other criteria, the position of the wing with respect to the body 102 and an illumination source, such as illumination sources 120, included in or on the doll 100.

Figure 7:
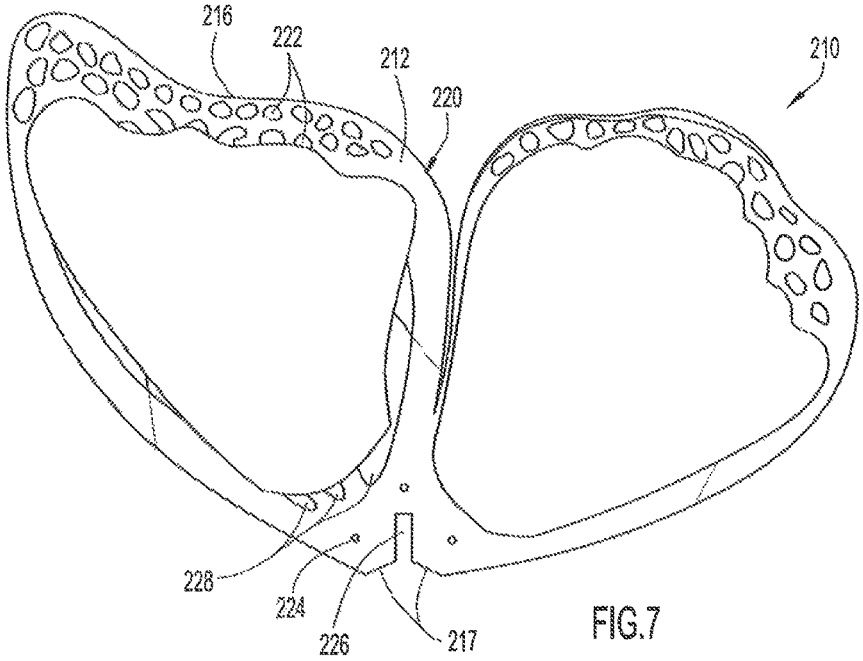
FIGS. 7-8 show a front and rear perspective view, respectively, of a first panel of the exemplary embodiment shown in FIG. 6.
Figure 8:
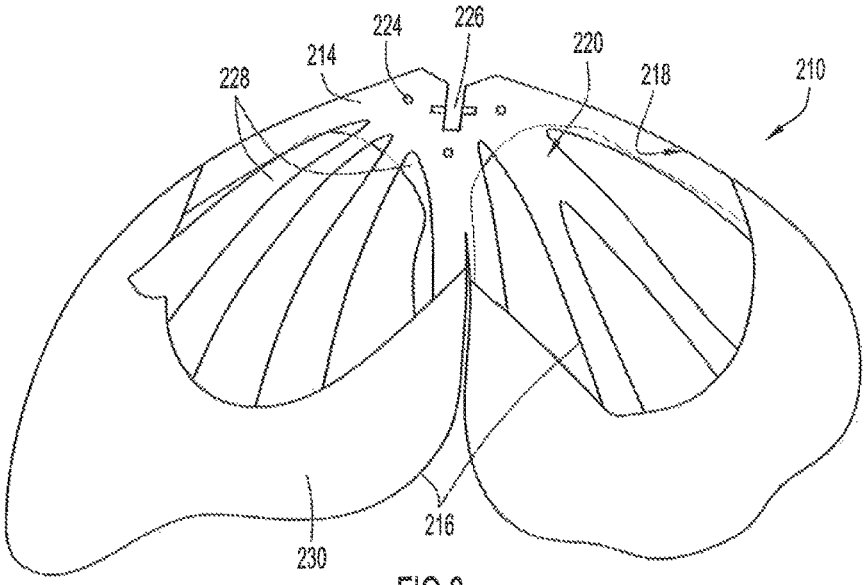

Now turning to FIGS. 7-8, an embodiment of the first panel 210 is shown from a front and rear perspective, respectively. First panel 210 includes a top wall 212 and a bottom wall 214 that, together with the exterior edge 216 form a housing 220. Housing 220 may be substantially solid or substantially hollow and may be constructed from any desirable material so long as housing 220 may allow light to travel through or within it. However, in some embodiments, light may be substantially prevented from exiting housing 220 via top wall 212, bottom wall 214, and exterior edge 216 and instead, may be directed to exit housing via a plurality of apertures or illumination areas 222. In some embodiments the second portion 20 may include light reflecting layers between or behind each of the panels in order to ensure that light may only be emitted from each panel in certain directions. The light reflecting layers may substantially cover an entire surface of a panel or, alternatively, a light reflecting layer may only cover a portion of a panel, as desired.

In some embodiments, such as the one shown in FIGS. 7-8, first panel 210 may also include openings 228, such that additional exterior edges 216 are actually formed within the periphery of first panel 210, as seen in FIG. 8. In other words, at least for the purposes of this application, the term "exterior edge" is not used to denote peripheral surfaces which define the exterior boundaries of a part or feature, but instead is used to denote exposed surfaces which are disposed between the top wall 212 and bottom wall 214, as shown in FIG. 8. Thus, in some embodiments, (i.e. those embodiments where first panel 210 is substantially hollow) housing 220 is actually defined by an inner surface 218 which is defined by the interior surfaces of top wall 212, bottom wall 214 and the surfaces disposed oppositely of exterior edges 216.

Still referring to the exemplary first panel 210 shown in FIGS. 7-8, the shape and design of the first panel 210, including the shape and size of the housing 220, the openings 228 and the illumination areas 222, are merely exemplary and can be changed or altered as desired. Additionally, the first panel may include additional features such as apertures 224 to assist in coupling first panel 210 to additional panels, such as second and third panels 240 and 270, and a recess 226 to assist in mounting first panel to a mounting 140 or other mounting mechanism.

Still further, panel 210 may include a cover 230 that substantially covers a portion of first panel 210. Cover 230 may be purely aesthetic, or may assist in preventing light from escaping from housing 220 at undesired locations. In some embodiments, cover 230 may be reflective and may substantially cover one side of panel 210, such that light only exits, or is emitted, from one side of panel 210. Cover 230 may also include various indicia, patterns or designs, such that when light is emitted from panel 210, the wing 200 appears to have a design. In the particular embodiment shown in FIGS. 7-8, a cover 230 substantially covers the part of the bottom wall 214 proximate the illumination areas 222 in order to ensure light being emitted at illumination areas 222 is projected forward. The cover 230 on the front wall 212 may also serve to prevent light emitted from other panels 240 and 270 placed forward of the panel 210 from propagating backwards to the panel 210.

Figure 9:
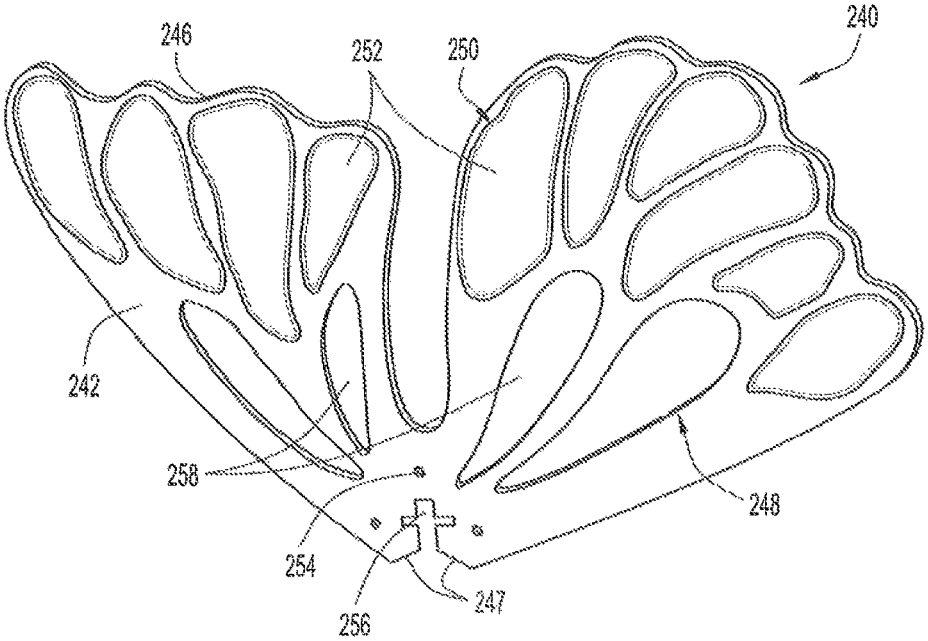
FIGS. 9-10 show front perspective views of a second panel and a third panel, respectively, of the exemplary embodiment shown in FIG. 6.

Now turning to FIG. 9, an exemplary embodiment of a second panel 240 is shown. Although the second panel may appear to be substantially different from the first panel 210 in design, it may be substantially similar in function. More specifically, although first panel 210 and second panel have different shapes, differently sized and shaped illumination areas, and differently sized and shaped openings, second panel 240 still has a top wall 242, a bottom wall (not shown) and an exterior edge 246 which define a housing 250 with illumination areas 252. Additionally, similar to panel 210, in some embodiments, housing 250 may actually be defined by an interior surface 248 and the second panel may also include additional features such as apertures 254 and recess 256 to assist in coupling second panel 240 to other panels or the body 102 of the toy doll 100. Most notably, despite the design differences between panels 240 and 210, the housing 250 of second panel 240 still provides a conduit for light to pass through such that it may enter panel 240 at entry surface 247 and exit second panel 240 at illumination areas 252.

Figure 12:
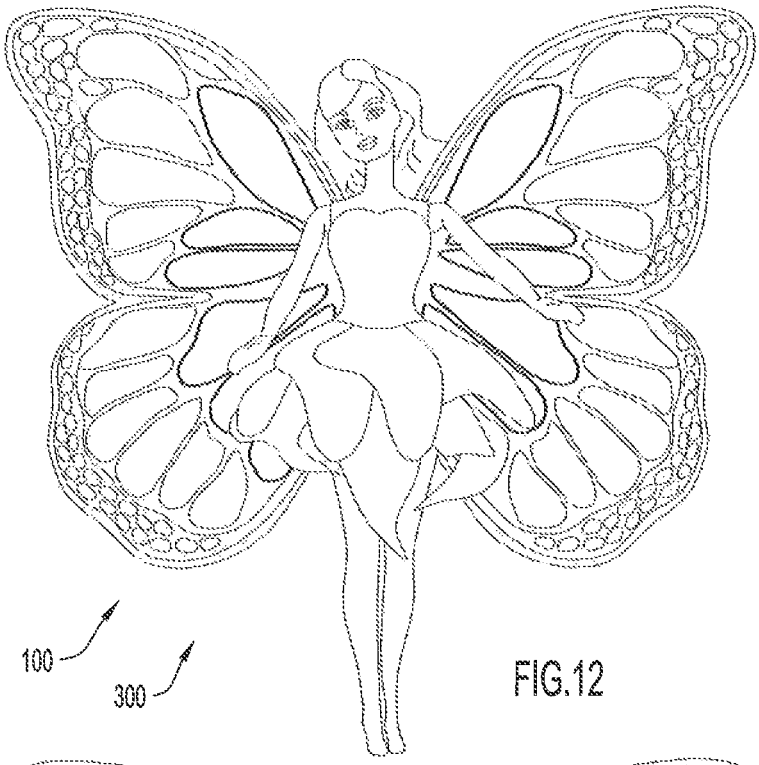
FIGS. 12-15 show front perspective views of the exemplary embodiment of FIG. 1 in various illumination configurations, in accordance with the present invention.
Figure 13:
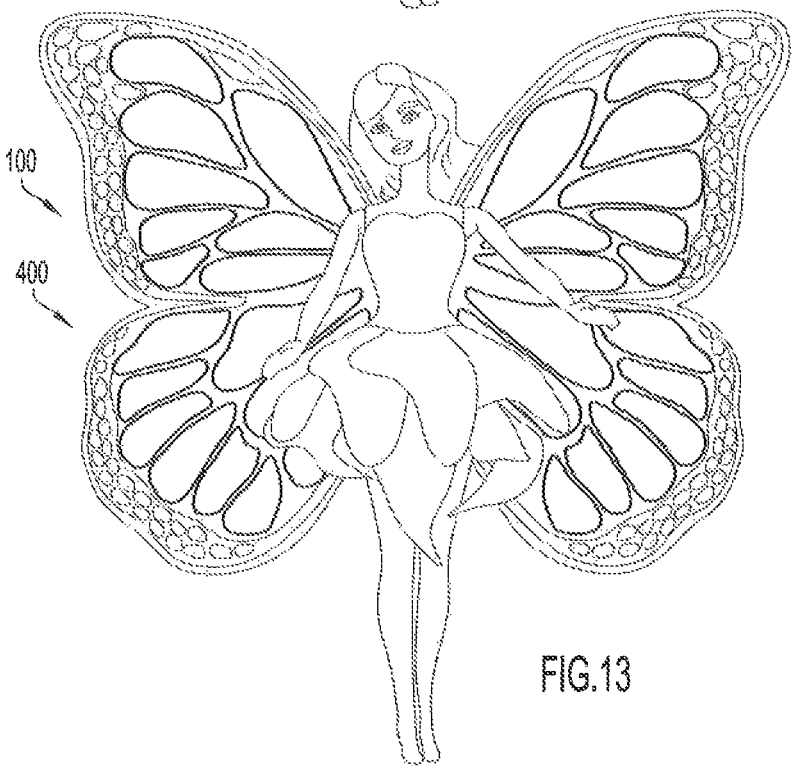

Next, turning to FIG. 10, an exemplary embodiment of a third panel 270 is shown. Similar to second panel 240, third panel 270 is slightly different in design from first panel 210 (as well as second panel 240), but again functions in substantially the same manner. Again, third panel 270 has a top wall 272, a bottom wall (not shown) and an exterior edge 276 that defines a housing 280 with illumination areas 282 in some embodiments and may have an interior edge 278 that may define the housing 280 in other embodiments. Third panel 270 may also include additional features, such as recess 286 and apertures 284 to facilitate coupling third panel 270 to other panels or portions of the toy doll 100. However, unlike panels 210 and 240, third panel 270 does not include any openings similar to openings 228, 258. Thus, the only exterior edges 276 included in the exemplary embodiment depicted in FIGS. 12-13 are disposed on the peripheral edges of third panel 270.

Still referring to FIG. 10, housing 280 of third panel 270 may, just like the respective housings of panels 210 and 240, act as a conduit for light to pass from entry surface 277 to illumination areas 282. However, due to the lack of openings in third panel 270, light may pass from entry surface 277 to illumination areas 282 with less risk of exiting or being emitted from panel 270 and, thus, may appear slightly brighter than light exiting panels 210 and 240. However, in other embodiments, the brightness of the light being emitted from panels 210, 240, 270 may be substantially the same.

Turning now to FIGS. 11A-C, FIGS. 11A-C show perspective views of an exemplary embodiment of wings 200 that are decoupled from the body 102 such that each panel 210, 240, 270 may be shown receiving light from an illumination source 120. As can be seen from these perspective views, the panels 210, 240, 270 are stacked atop of each other to form wing 200 and the entry surfaces 217, 247, and 277 are aligned to present a substantially continuous face to the illumination source 120. Thus, each of the entry surfaces 217, 247, 277 may be aligned with an illumination source 120 included in or on doll 100 in order to receive light and allow light to pass into housing 220, 250, 280, respectively. Additionally, since entry surfaces 217, 247, 277 may receive light from an illumination source 120, entry surfaces 217, 247, 277 may be colored or filtered in order to control the properties of any light inputs entering therethrough. For example, each of the entry surfaces 217, 247, 277 may be dyed or covered with ink of a particular color. In other embodiments, a colored gel may be adhered to the entry surface 217, 247, 277 or otherwise disposed between the illumination source 120 and the entry surface 217, 247, 277. As illustrated, different colors may be associated with each entry surface 217, 247, 277. For example, one entry surface may pass light into the wing with wavelengths corresponding to a blue color, while other entry surfaces may pass light with wavelengths corresponding to a pink or purple color.

In contrast, the exterior edges 216, 246, 276 (See FIGS. 7-10) of the panels 210, 240, 270 may be substantially clear or translucent and may each be uniquely shaped such that the exterior edge of wing 200 may appear to have a crevice or varying heights at different points. However, in other embodiments, the exterior edges 216, 246, 276 may be opaque or contiguous, as desired. Regardless, panels 210, 240, 270 may be simply stacked atop of each other and secured together by the doll mounting 140, but in other embodiments panels 210, 240, 270 may be secured together by some other fastener or adhesive. Furthermore, while panels 210, 240, 270 are shown stacked directly atop of each other, panels 210, 240, 270 may be stacked with space between the panels or with their entry surfaces offset from each other, as desired, in other embodiments.

As an example of how the panels 210, 240, 270 can be aligned with an illumination source, FIGS. 11A-C each show one of the panels 210, 240, 270 aligned with an illumination source 120 that is decoupled from a doll 100 for clarity. In FIG. 11A, an illumination source 120 is aligned with entry edge 217, such that the illumination areas 222 are illuminated. Similarly in FIGS. 11B and 11C, the illumination source 120 is aligned with either entry edge 247 or 277 such that illumination areas 252 and 282 are illuminated, respectively. As depicted in FIGS. 11A-C, a single panel may be illuminated at a time by the illumination source. In other embodiments, multiple panels may be illuminated at a given time by changing one or more properties of the illumination source, such as using an illumination source with a different or wider light emission pattern.

Although these figures are shown detached from a body 102 and/or mounting 140, it is to be understood that FIGS. 11A-C are representative of how the illumination source may be aligned with each panel 210, 240, 270 as the wings 200 rotate or pivot around or about a body 102. Thus, for example, in FIGS. 12-15, the wings 200 may be illuminated when they are aligned with an illumination source or sources 120 that are disposed adjacent to the entry surfaces 217, 247, and 277 of each panel 210, 240, 270. However, it is to be understood that in other embodiments, the illumination sources may be mounted within or at a desired distance from the entry surfaces 217, 247, 277.

Now referring generally to FIGS. 12-15, the toy doll 100 from FIG. 1 is shown in various illumination configurations. As will be discussed in more detail below, toy doll may be configured in various illumination configurations by altering the location of the set of wings, the orientation of the toy doll 10, or other desirable factors. For example, in FIGS. 12-14, toy doll 100 is oriented in an upward orientation and wings 200 are moved to various dispositions to alter the illumination configuration. By comparison, in FIG. 15, the wings 200 are moved to a similar disposition to the configuration shown in FIG. 14, but the doll is oriented at an angle, so the resulting illumination configuration is different.

Generally, and as is shown in more detail in FIGS. 11A-C, the various illumination configurations are achieved by aligning different panels of the wings 200 with the illumination source 120 of toy doll 100 when the illumination source 120 is activated such that different illumination areas receive a light input (via their respective housings, which receive light inputs at their respective entry surfaces). Additionally, or alternatively, different combinations of light panels may be aligned with different light outputs (such as different colors) from the illumination sources 120 to result in various combinations of illumination.

Figure 14:
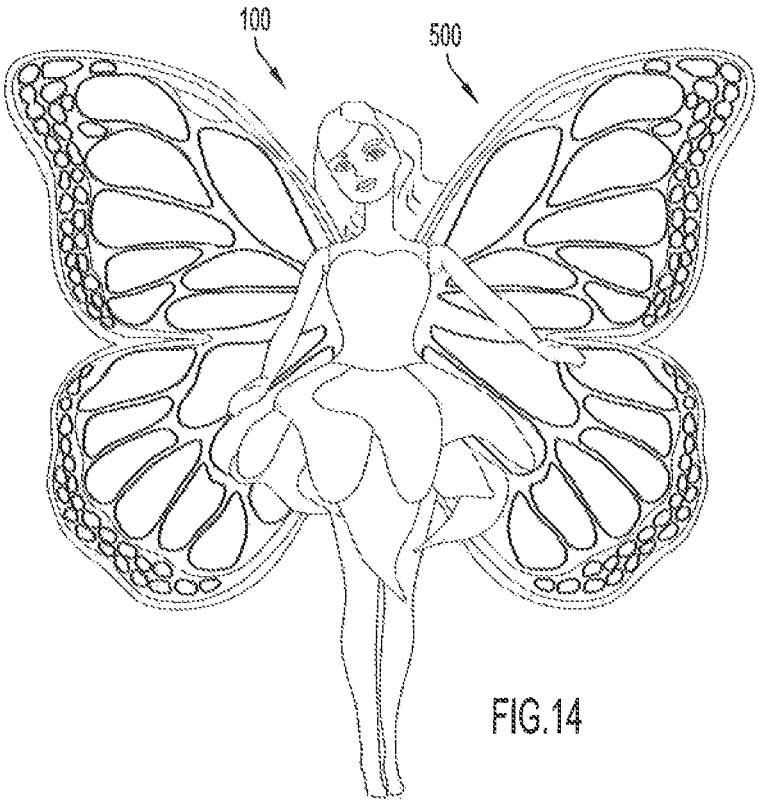

First, referring to FIGS. 12-14, toy doll 100 is shown in a substantially upright orientation. In each of these figures, the illumination source 120 is activated, but different illumination configurations are achieved by aligning different portions of wings 200 with the illumination source 120. In FIG. 12, the wings 200 are in a forward position and only the third panel 270 is aligned with the illumination source 120, resulting in an illumination configuration 300 that only has illumination areas 282 illuminated. By comparison, in FIG. 13, the wings are disposed between a forward and rearward position such that the third panel 270 and second panel 240 are aligned with the illumination source 120, resulting in an illumination configuration 400 in which illumination areas 252 and 282 are illuminated. Finally, in FIG. 14, wings 200 are in a rearward position and all of the panels 210, 240, 270 are aligned with the illumination source 120, such that illumination areas 222, 252, and 282 are all illuminated, resulting in illumination configuration 500.

Figure 15:
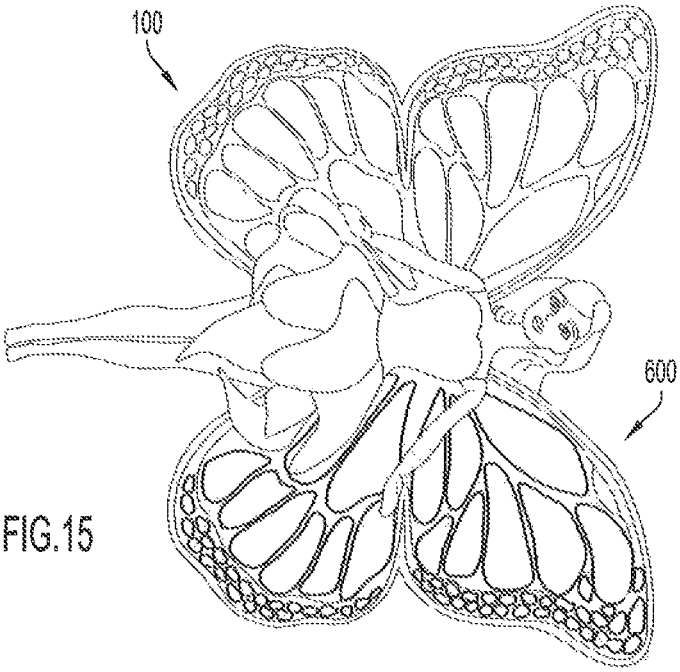

Next, referring to FIG. 15, toy doll 100 is shown again with wings 200 in a rearward position, such that illumination areas 222, 252, and 282 are all illuminated, but since the toy doll 100 is tilted or angled to a substantially side-ways orientation, only one half of the wings 200 are illuminated, resulting in an illumination configuration 600. Generally, when the toy doll 100 is tilted or angled to a certain position or past a certain threshold, any desired configuration of switches or sensors may adjust the lighting configuration. For example, two tilt sensors 122 (see FIG.3) may be utilized in conjunction with an illumination source 120 that includes four LEDs, such that different quadrants of wings 200 may be selectively illuminated. In this particular embodiment, a tilt switch or an accelerometer is utilized in connection with a light source 120 that includes two LEDs for each half of the wings 200. Thus, the tilt sensor or accelerometer may trigger two LEDs to remain off if the doll is tilted away from their side.

Furthermore, although the wings 200 shown in FIG. 15 show illumination areas 22, 252, and 282 that are all illuminated, it is to be understood that the various sensors or switches included in toy doll 100 may still actuate portions of the illumination source 120 when the wings are oriented in a different positions (i.e. the positions shown in configurations 300 and 400) to create additional illumination configurations. For example, toy doll 100 may be configured with only one side of the illumination areas 222 illuminated when tilted from illumination configuration 300 or with only side of illumination areas 222 and 252 illuminated when tilted from illumination configuration 400. Finally, in some embodiments, the wings 200 may be preprogrammed to automatically cycle through a specific pattern of illumination configurations, as desired. For example, a certain pattern of movement may trigger a certain pattern of illumination configurations. In other embodiments, a controller mounted to the toy coordinates a motorized fluttering motion, light intensity, and a sound output for a light and sound show by the toy.

Referring again to all of FIGS. 12-15, generally, it is to be understood the illumination configurations shown in each of these figures may be slightly altered to achieve further illumination configurations. In some embodiments, the illumination source 120 may output or project a white light, and the entry surfaces of each of the panels may be colored in order to filter the light entering into the wing and, thus, to create a colored wing. Thus, the color of the entry surface may simply be altered or partially altered in order to change the illumination configuration. However, in other configurations, the illumination source 120 may output colored light, such as with a tri-colored LED, so altering the light output may alter the illumination configuration. Furthermore, in yet other embodiments, a combination of these alterations may be used to achieve other additional illumination configurations.

Still referring generally to FIGS. 12-15, although the different illumination configurations seen in FIGS. 12-14 and 15 are achieved by moving the wings 200 into different positions, resulting in different panels 210, 240, 270 aligning with the illumination source 120, it is to be understood that any desirable illumination configuration may be achieved in any desirable manner. For example, instead of moving wings 200, the illumination source 120 may be manipulated in order to provide different light inputs to different panels. Furthermore, in other embodiments, the illumination source 120 may include one or more LEDs, such that different panels may be aligned with different colored LEDs to create different illumination configurations. As the number of LEDs included in the illumination source 120 and number of panels included in wings 200 increases, so does the number of possible illumination configurations. Furthermore, in some embodiments, the panels may receive light inputs from one or more portions of an illumination source 120 (i.e. two different colored LEDs) in order to create additional illumination configurations.

It is to be understood that a toy doll 100 may be fabricated from any suitable material, or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

It is also to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed:

1. A toy doll, comprising:

a first portion including an illumination source; and a second portion coupled to the first portion and movable relative to the first portion between a first position and a second position, the second portion including:

at least two panels, each panel defining a housing comprising:

an entry edge; and an illumination area that extends perpendicular to the entry edge and is illuminable when the entry edge is aligned with the illumination source, wherein at least the entry edge of a first panel of the at least two panels is alignable with the illumination source in the first position and at least the entry edge of a second panel of the at least two panels is alignable with the illumination source in the second position.

2. The toy doll of claim 1, wherein the first portion comprises a torso of a toy figure.

3. The toy doll of claim 1, wherein the second portion comprises wings coupled to the first portion and extending therefrom.

4. The toy doll of claim 1, wherein the second portion comprises a tail coupled to the first portion and extending therefrom.

5. The toy doll of claim 1, wherein the at least two panels are disposed in a stacked configuration.

6. The toy doll of claim 1, wherein at least one light reflective layer is included adjacent to the illumination area of one of the at least two panels, the light reflective layer reflecting light back into the panel to which it is adjacent.

7. The toy doll of claim 1, wherein the illumination area of the first panel, when aligned with the illumination source, emits a first pattern of light outputs and the illumination area of the second panel, when aligned with the illumination source, emits a second pattern of light outputs, the first pattern differing from the second pattern.

8. The toy doll of claim 7, wherein the first pattern illuminates a first part of the second portion and the second pattern illuminates a second part of the second portion, the first and second parts being offset from each other so that both parts may be seen when illuminated simultaneously.

9. The toy doll of claim 7 wherein the first pattern of light outputs is a first color and the second pattern of light outputs is a second color, the first and second color being different colors.

10. The toy doll of claim 1, wherein the first entry edge and the second entry edge can be moved into and out of alignment with the illumination source.

11. A toy comprising:

a first portion including a plurality of illumination sources housed therein; and a second portion, movably coupled to the first portion, the second portion including:

a first panel with a first set of parallel illumination surfaces and a first entry surface extending therebetween; and a second panel with a second set of parallel illumination surfaces and a second entry surface extending therebetween, wherein the first set of parallel illumination surfaces are illuminable when the first entry surface is aligned with one of the plurality of illumination sources, the second set of illumination surfaces are illuminable when the second entry surface is aligned with one of the plurality of illumination sources, and each of the first entry surface and the second entry surface are selectively alignable with at least one of the plurality of illumination sources.

12. The toy of claim 11, wherein the second portion is movably coupled to the first portion via a mounting, the mounting allowing the second portion to move about the first portion such that at least one of the first entry surface and the second entry surface can be moved into and out of alignment with at least one of the plurality of illumination sources.

13. The toy of claim 12, wherein the mounting comprises:

a rotatable support member, the rotatable support member allowing the second portion to pivot about the first portion such that at least one of the first entry surface and the second entry surface can be moved into and out of alignment with at least one of the plurality of illumination sources.

14. The toy of claim 13, wherein the second portion comprises at least two parts, each of the two parts comprising the first panel and the second panel, and the mounting further comprises:

a flexible support member, the flexible support member coupling the at least two parts together and being configured to move the at least two parts in unison.

15. The toy of claim 12, wherein the mounting allows the second portion to slide with respect to the first portion, such that at least one of the first panel or the second panel can be moved into alignment with the illumination source.

16. The toy of claim 12, wherein the first portion is a torso of a toy figure and the second portion is a set of wings, the mounting portion is configured to allow the wings to move in a flapping motion.

17. The toy of claim 12, further comprising:

a manipulation mechanism, wherein the manipulation mechanism may move the second portion with respect to the first portion by manipulating at least one of the mounting or the second portion.

18. A toy comprising:

a first portion including a plurality of illumination sources housed therein;

a second portion, movably coupled to the first portion, the second portion including:

a first panel including a first entry edge; and a second panel including a second entry edge, the first entry edge and the second entry edge each being alignable with at least one of the plurality of illumination sources, wherein the first panel is illuminable when the first entry edge is aligned with one of the plurality of illumination sources and the second panel is illuminable when the second entry edge is aligned with one of the plurality of illumination sources; and a sensor electronically coupled to the plurality of illumination sources and configured to manipulate the plurality of illumination sources in response to movement of the second portion.

19. The toy of claim 18, wherein the second portion comprises at least two parts.

20. The toy of claim 19, wherein one or more of the plurality of illumination sources are allocated to each of the at least two parts so that each of the at least two parts may be selectively illuminated.

21. The toy of claim 20, wherein each of the illumination sources may be selectively illuminated in response to inputs detected by the sensor.

22. The toy doll of claim 18, wherein:

the first panel further comprises a first illumination surface that is perpendicular to the first entry edge and illuminable when the first entry edge is aligned with one of the plurality of illumination sources; and the second panel further comprises a second illumination surface that is perpendicular to the second entry edge and illuminable when the second entry edge is aligned with one of the plurality of illumination sources.

* * * * *